US011814221B2

(12) United States Patent
Lesson et al.

(10) Patent No.: US 11,814,221 B2
(45) Date of Patent: Nov. 14, 2023

(54) TRIANGULAR PACKAGES AND METHODS OF MAKING THE SAME

(71) Applicant: BOBRICK WASHROOM EQUIPMENT, INC., North Hollywood, CA (US)

(72) Inventors: Timothy Lesson, Stillwater, NY (US); Ron Miller, Round Lake, NY (US); Mark Lawrence, Chatsworth, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 0 days.

(21) Appl. No.: 17/541,149

(22) Filed: Dec. 2, 2021

(65) Prior Publication Data

US 2023/0174266 A1 Jun. 8, 2023

(51) Int. Cl.
*B65D 5/20* (2006.01)
*B65D 77/00* (2006.01)
*B65B 53/02* (2006.01)

(52) U.S. Cl.
CPC ..... *B65D 5/2047* (2013.01); *B65B 53/02* (2013.01); *B65D 77/003* (2013.01)

(58) Field of Classification Search
CPC ..... B65D 5/029; B65D 5/2042; B65D 5/008; B65D 5/2061; B65D 5/2047; B65D 77/003
USPC ..... 229/103.2, 112, 115
See application file for complete search history.

(56) References Cited

U.S. PATENT DOCUMENTS 1,152,471 A * 9/1915 Anthony ..... B65D 77/24 206/240
D76,634 S 10/1928 Reigel
1,833,419 A * 11/1931 Grossen ..... B65D 81/36 206/102
D91,023 S 11/1933 Ellsworth
3,482,760 A * 12/1969 Boehm ..... B65D 5/0254 229/115
3,985,288 A * 10/1976 Bell ..... B65D 5/48014 229/115
D252,446 S 7/1979 Traugott
D267,544 S 1/1983 Neto
5,042,657 A * 8/1991 Dunn ..... B65D 5/029 229/199
5,107,985 A * 4/1992 Bezrutczyk ..... B65D 5/0254 206/757
D334,887 S 4/1993 Barbans
D338,620 S 8/1993 Brozowski
D339,061 S 9/1993 Kilmartin, III
(Continued)

OTHER PUBLICATIONS

Office action issued in related U.S. Appl. No. 29/817,679, dated Aug. 2, 2023, 14 pages.

(Continued)

*Primary Examiner* — Christopher R Demeree
(74) *Attorney, Agent, or Firm* — LEWIS ROCA ROTHGERBER CHRISTIE LLP

(57) ABSTRACT

A triangular package includes three sides and two end tab each covering a portion of an end of the triangular package. A method of forming a triangular package includes bending side portions of stock material to form the sides of the triangular packaging and shrink wrapping the triangular package causing tabs to cover portions of the triangular package ends.

18 Claims, 4 Drawing Sheets

(56) References Cited

U.S. PATENT DOCUMENTS

| | | | | |
|---|---|---|---|---|
| D356,033 | S | 3/1995 | Horvat | |
| D361,038 | S | 8/1995 | Klappet | |
| D361,262 | S | 8/1995 | Lusker | |
| 5,503,325 | A * | 4/1996 | Nelson | B65D 5/4283 229/148 |
| D398,429 | S | 9/1998 | LeBlanc | |
| D424,430 | S | 5/2000 | Seidler | |
| D437,221 | S | 2/2001 | Sagel | |
| D439,838 | S | 4/2001 | Sagel | |
| D440,875 | S | 4/2001 | Sagel | |
| D442,861 | S | 5/2001 | Sagel | |
| D463,278 | S | 9/2002 | Weinstein | |
| D465,155 | S | 11/2002 | Weinstein | |
| D496,286 | S | 9/2004 | Krunas | |
| D497,038 | S | 10/2004 | Tsai | |
| D500,448 | S | 1/2005 | Krunas | |
| 7,347,326 | B2 * | 3/2008 | Baechle | B65D 5/009 206/453 |
| D575,635 | S | 8/2008 | Rozenzweig | |
| D585,707 | S | 2/2009 | Weinstein | |
| 7,699,211 | B2 * | 4/2010 | Holloway | B65D 5/4279 229/138 |
| D618,415 | S * | 6/2010 | Greseth | D34/1 |
| D622,606 | S | 8/2010 | Masotti | |
| D652,715 | S | 1/2012 | Quinter | |
| D672,233 | S | 12/2012 | Green | |
| D682,090 | S | 5/2013 | Scatterday | |
| D683,214 | S | 5/2013 | McAdam | |
| D684,463 | S | 6/2013 | Elfstrum | |
| D694,636 | S | 12/2013 | Grossfield | |
| D774,399 | S | 12/2016 | Borer | |
| 9,682,792 | B2 * | 6/2017 | Shoff | B65D 5/04 |
| D805,911 | S | 12/2017 | Borer | |
| 10,227,169 | B1 * | 3/2019 | Mueller | B65D 77/003 |
| D849,528 | S * | 5/2019 | Riha | D9/430 |
| D904,018 | S | 12/2020 | Ziemann | |
| D908,965 | S | 1/2021 | Pae | |
| D926,565 | S | 8/2021 | Beckmann Legorreta | |
| 2006/0169754 | A1 * | 8/2006 | Tseng | B65D 77/042 229/162.1 |

OTHER PUBLICATIONS

Kite Packaging, Sep. 20, 2017, YouTube Video Post, URL:https://www.youtube.com/watch?v=-a7KCsgB6c4 (Year: 2017).

Erdiie Industries,Jul. 5, 2015, YouTube Video Post, URL:https://www.youtube.com/watch?v=W_fA6Z449E (Year: 2015).

Blake Store, Oct. 22, 2020,Amazon.com Product Post, URL:https://www.amazon.com/Plastic-Recycled-Tri-tube-Postal-PTT4/dp/B08LDVXTD8?th=1 (Year: 2020).

Azbigmedia, Mar. 25, 2021, azbigmedia.com Post, URL:https://azbigmedia.com/business/what-are-triangular-boxes-used-for/ (Year: 2021).

Aviditi Store, Nov. 29, 2007, Amazon.com Product Post, URL:https://www.amazon.com/Aviditi-Corrugated-Cardboard-Protecting-Irregular-Shaped/dp/B000ZJQIAM (Year: 2007).

E-commercant, wayback machine date Oct. 25, 2021, e-commercant.shop, URL:https://www.ecommercant.shop/boutique/emballages-ecommerce/tube-carton/tube-expedition-triangulai re .html (Year: 2021).

* cited by examiner

TRIANGULAR PACKAGES AND METHODS OF MAKING THE SAME

BACKGROUND

Triangular packages are often made out of carton or corrugated board. The body the triangular package is typically formed first and end caps are often formed separately to cap the ends of the triangular package. Current methods of forming such packages tend to be time and material consuming.

SUMMARY

In an example embodiment, a triangular package includes a base, a first side extending from the base, and a second side extending from the base opposite the first side and extending toward the first side, such that the base, the first side and the second side define a triangular body having a first end opposite a second end. The base, the first side and the second side define a first triangular opening on the first end of the triangular body and a second triangular opening on the second end of the triangular body. The triangular package also includes a first tab extending from a first end of the base and covering a first portion of the first triangular opening. The triangular package further includes a second tab extending from a second end of the base opposite the first end and covering a first portion of the second triangular opening. A shrink wrapping is provided over the body, the first and second tabs, and over a second portion of each of the first and second triangular openings, such that a portion of each triangular opening is only covered by the shrink wrap. In an example embodiment, at least one of the tabs is trapezoidal in shape and has a base side adjacent the base of the triangular body, such that the trapezoidal shaped tab has a first side opposite a second side and a top side opposite its base side. The first and second sides of the trapezoidal shaped tab extend from the base side to the top side, and the first side of the trapezoidal shaped tab is adjacent the first side of the triangular body and the second side of the trapezoidal shaped tab is adjacent the second side of the triangular body. In another example embodiment, the first side of the triangular body extends along a first angle relative to the base, and the second side of the triangular body extends at a second angle relative to the base. In addition, the first side of the trapezoidal shaped tab extends relative the base side of the trapezoidal shaped tab at a first tab angle that is the same as the first angle, and the second side of the trapezoidal shaped tab extends relative the base side of the trapezoidal shaped tab at a second tab angle that is the same as the second angle. In yet another example embodiment, the base side of the trapezoidal shaped tab has a length shorter than a length of its corresponding end of the first and second corresponding ends of the base of the triangular body. In a further example embodiment, the first side of the trapezoidal shape tab engages the first side of the triangular body and the second side of the trapezoidal shaped tab engages the second side of the triangular body. In yet a further example embodiment, the first side of the triangular body extends along a first angle relative to the base, and the second side of the triangular body extends at a second angle relative to the base. With this embodiment, the first side of one of the trapezoidal shaped tabs extends relative the base side of such trapezoidal shaped tab at a first tab angle that is less than the first angle, and the second side of such trapezoidal shaped tab extends relative the base side of such trapezoidal shaped tab at a second tab angle that is less than the second angle.

In yet a further example embodiment, the base side of such trapezoidal shaped tab has a length shorter than a length of its corresponding end of the first and second corresponding ends of the base of the triangular body. In one example embodiment, at least one of the tabs is quadrilateral in shape, such that the quadrilateral shaped tab has a base side adjacent the base of the triangular body, a first side opposite a second side and a top side opposite its base side. The first and second sides of the quadrilateral shaped tab extend from the base side to the top side. In another example embodiment, the base side of the quadrilateral shaped tab has a length shorter than a length of its corresponding end of the first and second corresponding ends of the base of the triangular body. In another example embodiment, each tab does not extend externally beyond the first and second sides and the base of the triangular body. In yet another example embodiment, the first tab covers less than 90% of the first triangular opening, and wherein the second tab covers less than 90% of the second triangular opening. In a further example embodiment, the first tab covers less than 50% of the first triangular opening, and the second tab covers less than 50% of the second triangular opening. In an example embodiment, each of the tabs does not extend beyond the triangular body of the triangular package.

In an example embodiment, a method for forming a triangular package includes bending a first portion of a stock material relative to a third portion of the stock material, and bending a second portion of the stock material relative the third portion. The method also included connecting the first portion to the second portion to define a triangular body, such that the third portion forms a base of the triangular body, the first portion forms a first side of the triangular body and the second portion forms a second side of the triangular body. In addition, a first triangular opening is defined at a first end of the triangular body, and a second triangular opening is defined at a second end of the triangular body. A first tab extends from the base from the first end of the triangular body and a second tab extends from the base portions from the second end opposite the first end. The method further includes covering the triangular body with a shrink wrap material, and shrinking the shrink wrap material causing the first tab to bend relative to the base to cover a portion of the first triangular opening and causing the second tab to bend relative to the base and cover a portion of the second triangular opening. In an example embodiment, shrinking of the shrink wrap material is accomplished by heating. Once the shrink wrap material is shrunk over the triangular body, a portion of each triangular opening is only covered by the shrink wrap material. In another example embodiment, the method includes placing an object to be packaged by the triangular package on the third portion prior to bending the first and second portions. In yet another example embodiment, the object cannot fit through a portion of the first triangular opening not covered by the first tab and the portion of the second triangular opening not covered by the second tab. In a further example embodiment, connecting includes connecting the first portion to the second portion with tape. In yet a further example embodiment, at least one of the first and second tabs is trapezoidal in shape. In yet another example embodiment, at least one of the first and second tabs is a quadrilateral in shape. In a further example embodiment, at least one of the tabs engages the first and second sides. In a further example embodiment shrinking causes the first tab to cover less than 50% of the first triangular opening and the second tab to cover less than 50% of the second triangular opening.

DESCRIPTION

Figure 1B:
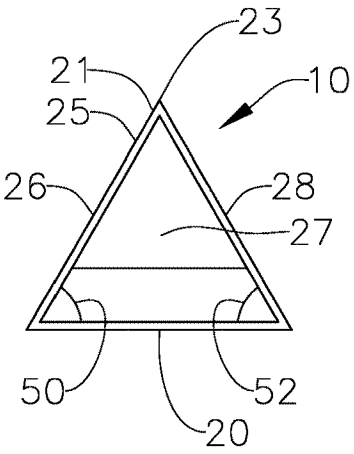
FIG. 1B is an end view of a triangular package formed with the stock material shown in FIG. 1A.

To form a triangular package 10 as for example shown in FIGS. 1B, 2B, 3, 4, and 5, carton stock, or cardboard which may be corrugated, or any other type of sheet material with similar characteristics may be used. For illustrative purposes, the package forming material is referred to herein as the "stock material" 12, as for example shown in FIGS. 1A and 2A. To form the triangular package, a section of the stock material 12 is bent along two parallel fold lines 16*a*, 16*b*. To aid in bending, the material may be scored or weakened along two parallel lines to form the fold lines 16*a*, 16*b*. The stock material portion 18 between the two parallel fold lines will define a base 20 of the triangular package. For convenience this portion is referred to herein as the "base portion" 18 of the stock material. Two end portions 22, 24 of the stock material extending adjacent the base portion from each of the fold lines 16*a*, 16*b* will form two opposite sides (i.e., a first side 26 and a second side 28) of the triangular package. The two sides in an example embodiment are of equal length so as to form an isosceles or equilateral triangle. In another example embodiment, the two sides may not have an equal length and thus, may form a scalene triangle.

Figure 1A:
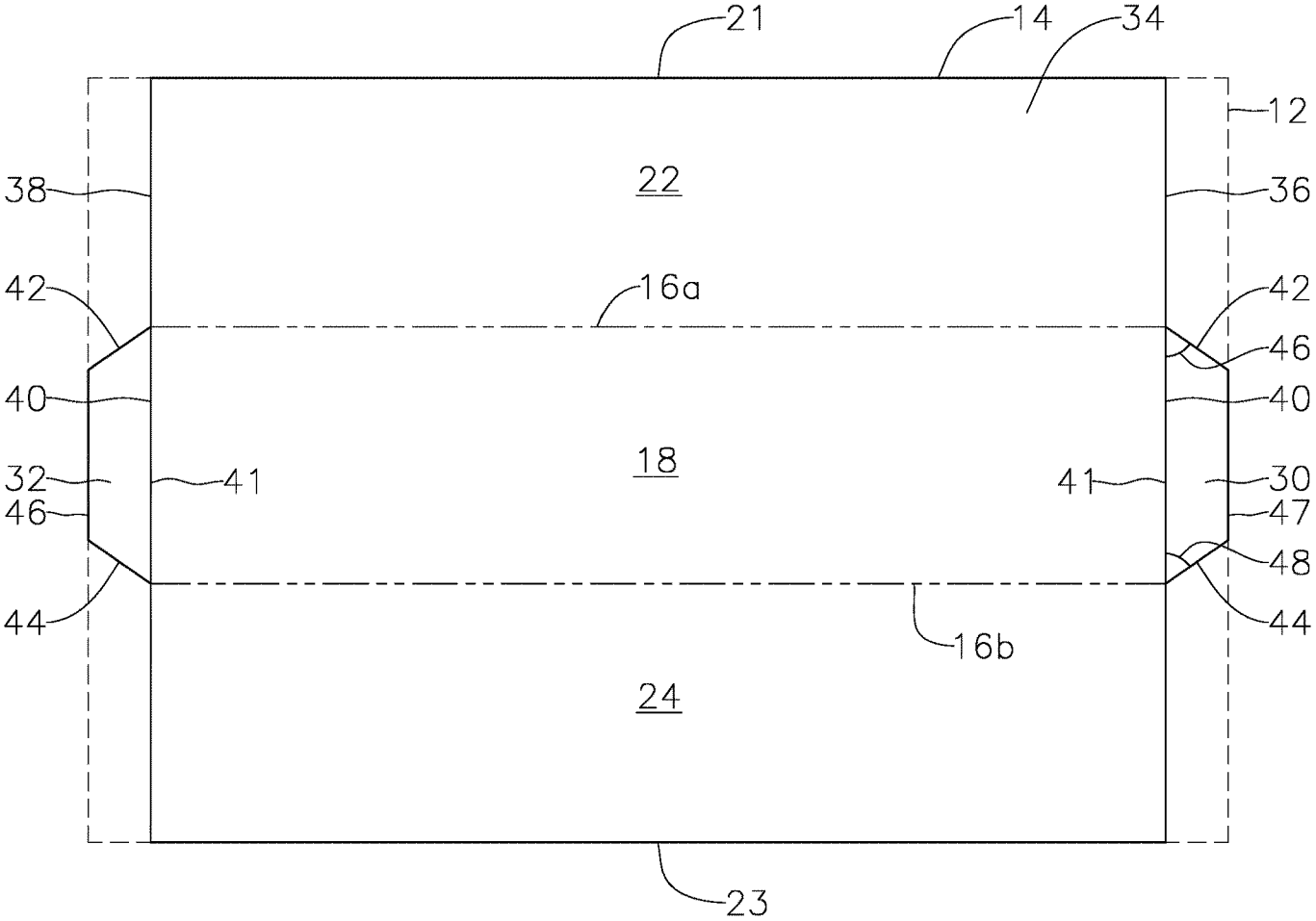
FIG. 1A is plan view of an example embodiment stock material cut for forming an example embodiment triangular package.
Figure 2B:
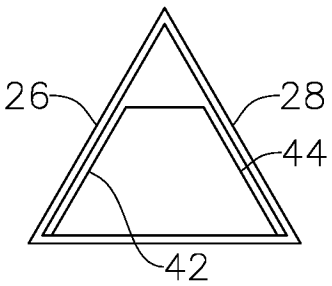
FIG. 2B is an end view of a triangular package formed with the stock material shown in FIG. 2A.
Figure 2A:
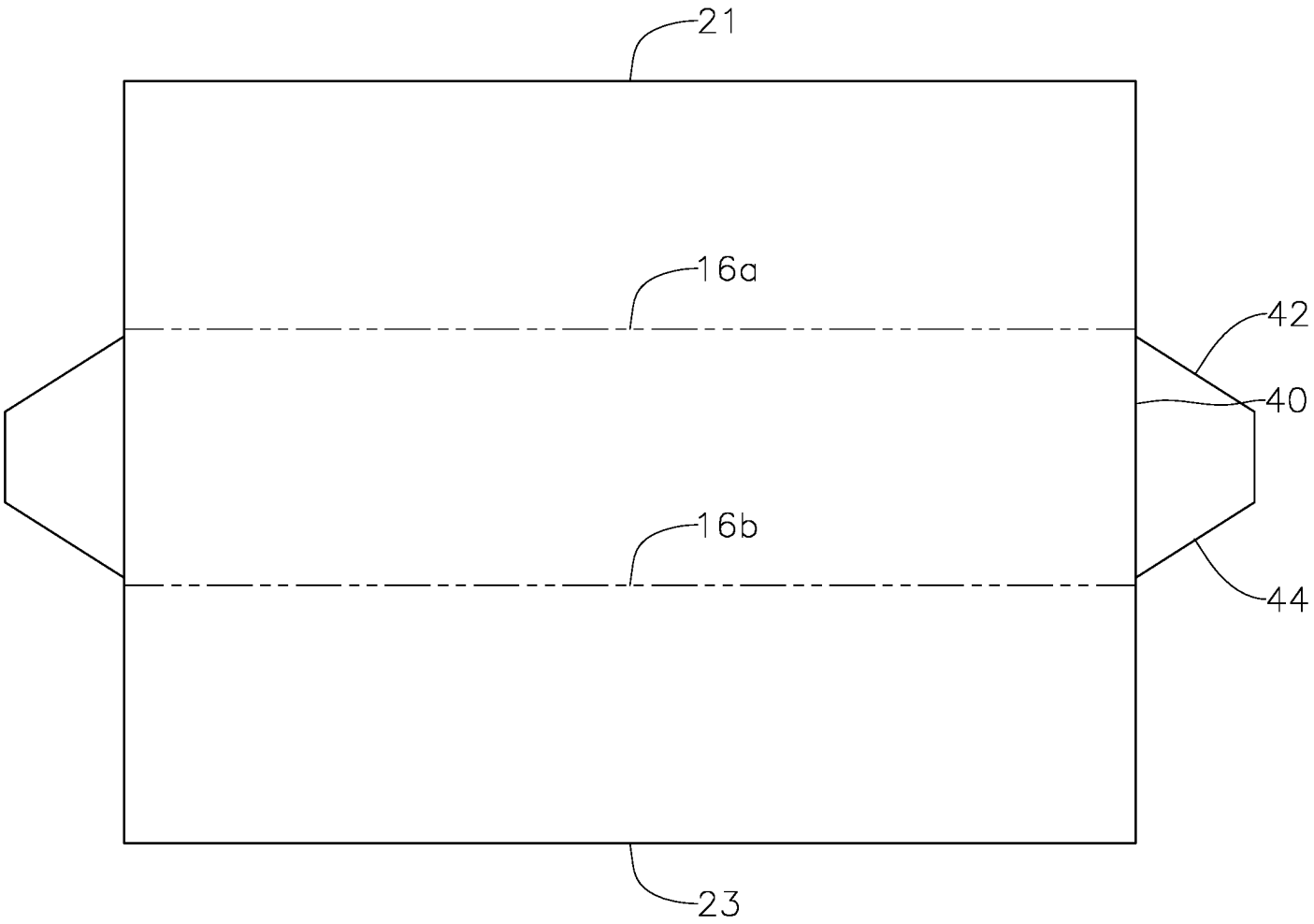
FIG. 2A is plan view of another example embodiment stock material cut for forming another example embodiment triangular package.

Prior to forming a triangular package, the stock of material is cut into a quadrilateral shape with opposite tabs 30, 32 extending from the base portion of the stock material, i.e., the portion of the material between the fold lines 16*a*, 16*b*. In other words, once cut, the stock material has a quadrilateral shaped body 34 and two tabs 30, 32 extending from opposite sides 36, 38 of the quadrilateral shaped body, respectively. Each tab has a base side or base 40 adjacent its corresponding side of the body base portion and extends distally a distance from its corresponding side of the body. In example embodiment, the base 40 of a tab extends the entire length of its corresponding side 36, 38, between the fold lines 16*a*, 16*b*, as shown in FIGS. 1A and 1B. In other example embodiments, the base of the tab does extend along the entire length of the base portion of the stock material as defined between the fold lines and may not extend to both fold lines, as for example shown in FIGS. 2A and 2B.

To form the triangular package, the two end portions 22, 24 of the stock material are bent relative to the base portion along the fold lines until their distal ends opposite the fold lines, referred to as their free ends 21, 23, abut each to define the body 25 of the triangular package having opposite triangular openings 27. The two tabs are also bent upwards to cover at least a portion of their corresponding triangular openings. To aid in the bending of the tabs, the material stock may be scored along the base 40 of each tab to form a tab fold line 41.

Figure 3:
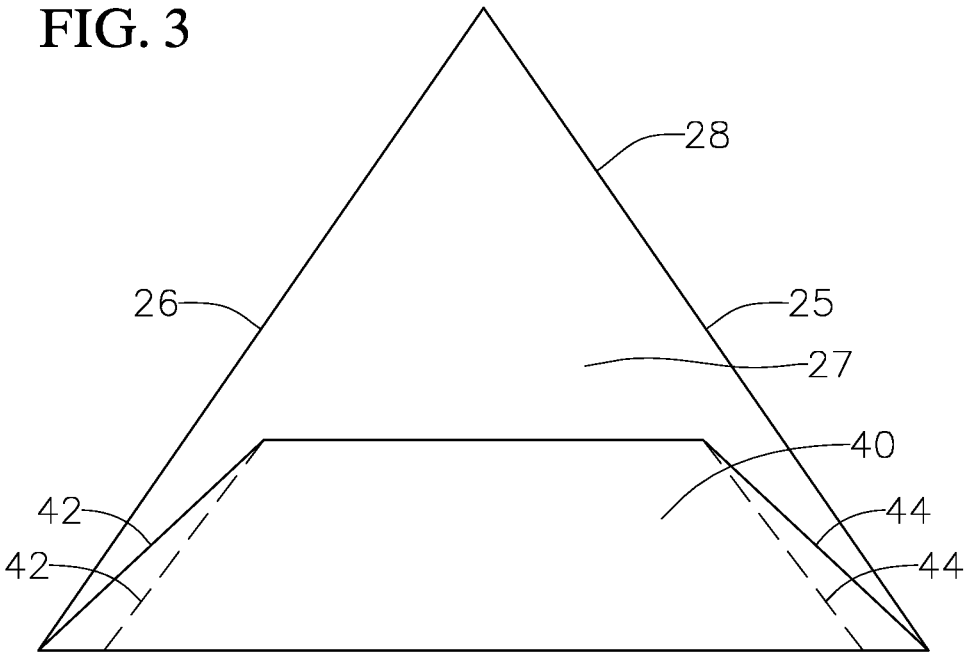
FIG. 3 is an end view of a further example embodiment triangular package.

In an example embodiment, each tab is trapezoidal in plan view, as for example shown in FIGS. 1A, 1B, 2A, 2B, and 3. The trapezoidal shaped tabs have two opposite sides 42, 44 extending from the base 40 (which defines the wider base of the trapezoidal shaped tab) to a narrower base (or free side) 47. In the example embodiment as shown in FIGS. 1A and 1B, the wider base of the trapezoidal tab spans the entire distance between the fold lines 16*a*, 16*b* and the sides 42, 44 of each tab extend from their corresponding wider base at a tab angle 46, 48, respectively, which is the same as (or slightly larger than) the corresponding body angle 50, 52 that the corresponding sides 26, 28 of the triangular package body extend from the base of the triangular package body. In this regard, when the tabs are folded (i.e., bent) upwards, the sides of the tabs engage or abut the corresponding ends of the sides of the triangular package body. In the shown example embodiment, the tabs do not extend beyond the triangular body of the triangular package. In another example embodiment, as shown in FIG. 3, the base of the tab extends the entire distance between the fold lines, but the sides of the tab extend from their base at an angle 46, 48 smaller than the corresponding body angles 50, 52, that the corresponding sides of the triangular package body extend from the triangular package body base. With this embodiment, when folded upwards, the sides of the trapezoidal tab would not engage the corresponding sides of the triangular package. In a further example embodiment, where the base 40 of the trapezoidal tab does not extend the entire distance between the two fold lines 16*a*, 16*b* and is spaced apart between the two fold lines, as for example shown in FIGS. 2A, 2B in dashed lines, and FIG. 3, the tab will not engage the sides of the triangular package. In other example embodiments, where the base of the tab does not extend the entire distance between the fold lines, the tab angles may be the same, larger or smaller than the corresponding body angles.

Figure 4:
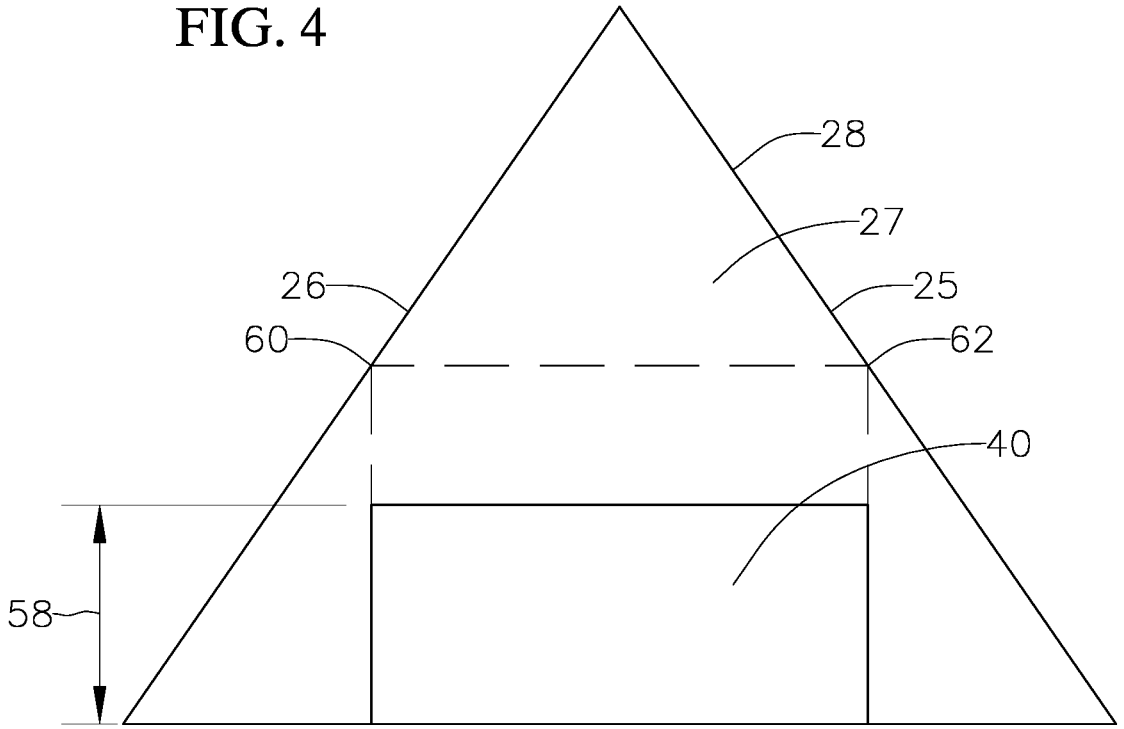
FIG. 4 is an end view of yet a further example embodiment triangular package.

In other example embodiments, the tab may have other shapes, such that when folded they cover at least a portion of their corresponding triangular opening. In an example embodiments, the free or distal sides of the tabs distal from their base may not be linear. In one example embodiment as shown in FIG. 4, a tab 40 may be a quadrilateral. In the shown example embodiment, the tab does not extend to the fold lines 16*a*, 16*b*. The tab may have a height 58 such that when folded it does not engage the sides 26, 28 of the triangular opening as shown in FIG. 4 in solid line or it may have a height extended as shown in dashed lines such that the upper corners 60, 62 of the tab engage the corresponding sides 26, 28 of the triangular package body. In another example embodiment, the tab may be a trapezoid such that the base of the trapezoid defined at the base of the triangular package body is the narrower base while the wider base extends distally therefrom.

In all example embodiments, the tabs are such that they cover part of the triangular openings without extending externally from the triangular package. In one example embodiment, the tab may be triangular in shape and may be sized to cover the entirety of its corresponding opening.

To minimize stock material waste, the length of the stock material needed may be reduced for given length triangular package by making the end tabs to have a shorter length so as to not cover the entire of the corresponding triangular opening. For example, this may be achieved by making the tabs trapezoidal or quadrilateral shape as for example shown in FIGS. 1-5.

Figure 5:
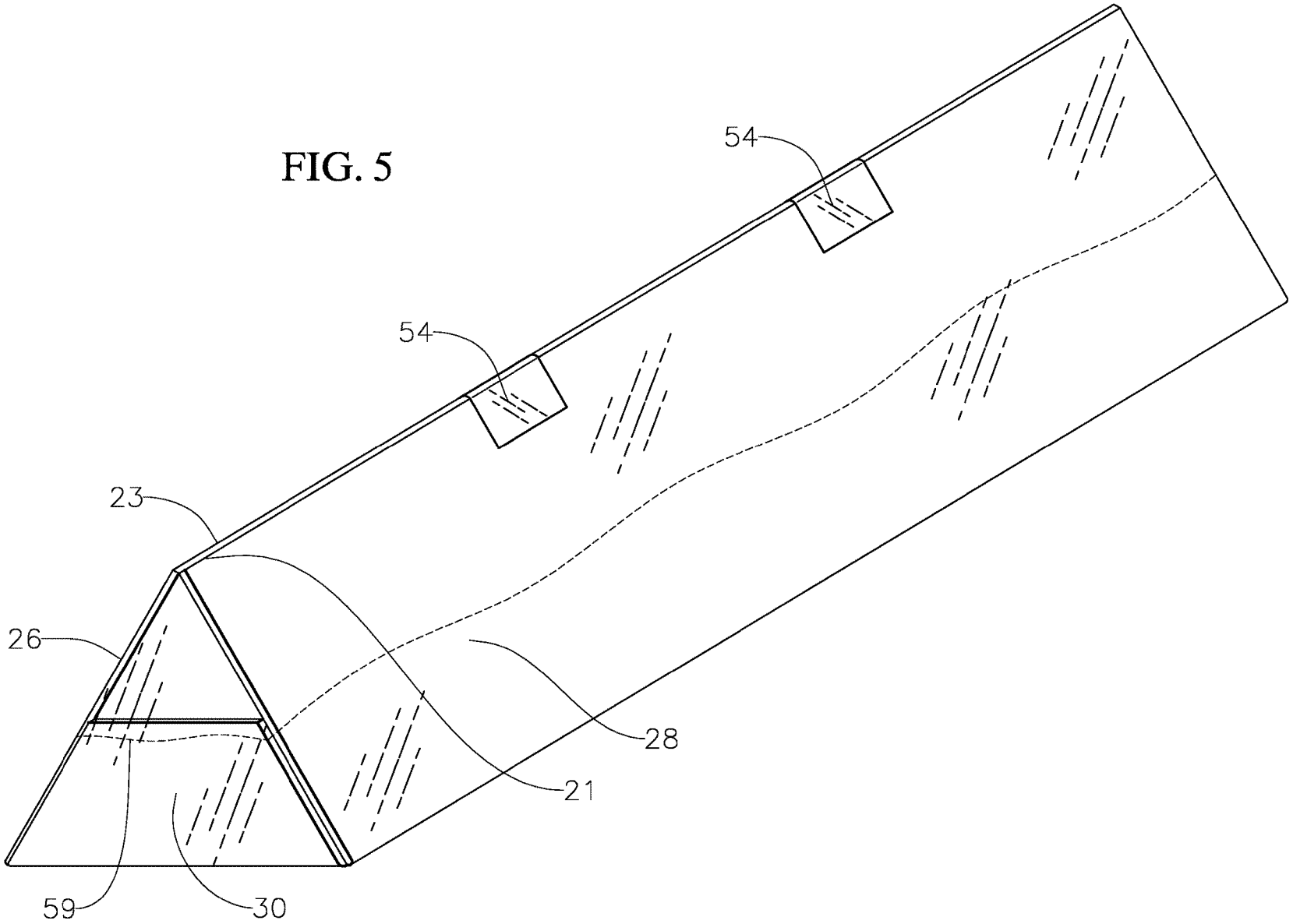
FIG. 5 is a perspective view of an example embodiment triangular package.

A product being packaged is placed on the base portion 18 of the material stock. The end portions 22, 24 are folded up to engage each other by in an example embodiment being bent along their corresponding fold lines 16*a*, 16*b*. Adhesive tape 54, such a scotch tape, adhered to the outer surfaces of the two folded end portions may be used to hold the two folded end portions together in a folded orientation, as for example shown in FIG. 5. In an example embodiment, the tape holds the free ends 21, 23 of the end portions of the stock material close to each other or against each other so as to define an almost triangular package body or the triangular package body. The formed package body with the product is placed within a plastic shrink bag, and the bag is sealed. In another example embodiment, the triangular or almost triangular body with the product is covered in a shrink wrap type material. The bagged or covered body is then heated causing the bag or shrink wrap material to form a shrink wrap 59 over the body and the tabs to bend to cover the triangular end openings of the triangular body to form a shrink wrapped triangular package, as shown in FIG. 5. In other words, the tabs are folded (i.e., bent) relative to the base portion 18 by the shrinking of the shrink wrap material. The bent tabs provide sufficient support for retaining the product within the triangular package. The embodiments in which the tabs engage the sides of their corresponding triangular openings may provide for a stronger package. In the case, where the tabs are formed shorter to save the stock material, the packaging works well with products whose dimension are such that they cannot fit through the end openings of the triangular package that are not covered by the tabs. In this regard, the tabs provide side support to the product.

In an example embodiment, each tab when bent over its corresponding body triangular end opening occupies more than 20% of area of the triangular end opening 27 but less than 90% of the area of the triangular end opening 27. In another example embodiment, each tab when bent over its corresponding body triangular end opening occupies more than 20% of area of the triangular end opening but less than 50% of the area of the triangular end. In one example embodiment, each tab is trapezoidal in plan view such that its sides are complementary to the sides of the triangular body and such tab has a height of about ⅓ the height of the triangular opening. In another example embodiment, the height of each trapezoidal tab is between 15% to 50% of the height of its corresponding triangular opening. In a further example embodiment, each tab occupies about ⅔ the height of its corresponding triangular end opening. In a further example embodiment, the tab occupies less than 90% of its corresponding body triangular end opening. In yet a further example embodiment, the tab occupies less than 70% of its corresponding body triangular end opening. In another example embodiment, the tab occupies less than 50% of its corresponding body triangular end opening. In yet another example embodiment, the tab occupies less than 30% of its corresponding body triangular end opening.

In other example embodiments, the two tabs may have a different height from each other. This may be useful in cases where the product to be packaged occupies a smaller area at one end and a larger area at another end. In this regard, a shorter tab may be used to block the end proximate the larger area end of the product, and a longer tab may be used to block the triangular end opening proximate the smaller area end of the product. The tab should be long or large enough to block enough of their corresponding openings for preventing a product from sliding out through such opening. By selecting the size/height of the tabs further stock material may be saved in forming the triangular packages. In the shown example embodiments, the tabs do not extend beyond the triangular body of the triangular package. In other words that tabs to do not extend past the outer surfaces of the triangular body.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Moreover, although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" or "over" another component, it can be directly on or over the other component, or components may also be present therebetween. Moreover, when a component is component is referred to as being "coupled" to another component, it can be directly attached to the other component or intervening components may be present therebetween.

The invention claimed is:

1. A triangular package comprising:

a base;

a first side extending from the base;

a second side extending from the base opposite the first side and extending toward the first side, wherein the base, the first side and the second side define a triangular body having a first end opposite a second end, wherein the base, the first side and the second side define a first triangular opening on said first end and a second triangular opening on said second end;

a first tab extending from a first end of the base and covering a first portion of the first triangular opening;

a second tab extending from a second end of the base opposite the first end and covering a first portion of the second triangular opening; and a shrink wrap material over the body, the first and second tabs and over a second portion of each of the first and second triangular openings, wherein a portion of each triangular opening is only covered by said shrink wrap material, wherein at least one of said tabs is trapezoidal in shape, wherein said trapezoidal shaped tab has a base side adjacent the base of the triangular body, wherein trapezoidal shaped tab has a first side opposite a second side and a top side opposite its base side, wherein the first and second sides of said trapezoidal shaped tab extend from the base side to the top side, and wherein the first side of said trapezoidal shaped tab is adjacent the first side of the triangular body and the second side of said trapezoidal shaped tab is adjacent the second side of the triangular body.

2. The package as recited in claim 1, wherein the first side of the triangular body extends along a first angle relative to the base, and wherein the second side of the triangular body extends at a second angle relative to the base, wherein the first side of said trapezoidal shaped tab extends relative the base side of said trapezoidal shaped tab at a first tab angle that is the same as the first angle, and wherein the second side of said trapezoidal shaped tab extends relative the base side of said trapezoidal shaped tab at a second tab angle that is the same as the second angle.

3. The package as recited in claim 2, wherein the base side of the trapezoidal shaped tab has a length shorter than a length of its corresponding end of said first and second corresponding ends of said base of the triangular body.

4. The package as recited in claim 2, wherein the first side of the trapezoidal shape tab engages the first side of the triangular body and the second side of the trapezoidal shaped tab engages the second side of the triangular body.

5. The package as recited in claim 1, wherein the first side of the triangular body extends along a first angle relative to the base, and wherein the second side of the triangular body extends at a second angle relative to the base, wherein the first side of one of said first and second trapezoidal shaped tabs extends relative the base side of said one trapezoidal shaped tab at a first tab angle that is less than the first angle, and wherein the second side of said one trapezoidal shaped tabs extends relative the base side of said one trapezoidal shaped tab at a second tab angle that is less than the second angle.

6. The package as recited in claim 5, wherein the base side of said one trapezoidal shaped tab has a length shorter than a length of its corresponding end of said first and second corresponding ends of said base of said triangular body.

7. A triangular package comprising:

a base;

a first side extending from the base;

a second side extending from the base opposite the first side and extending toward the first side, wherein the base, the first side and the second side define a triangular body having a first end opposite a second end, wherein the base, the first side and the second side define a first triangular opening on said first end and a second triangular opening on said second end;

a first tab extending from a first end of the base and covering a first portion of the first triangular opening;

a second tab extending from a second end of the base opposite the first end and covering a first portion of the second triangular opening; and a shrink wrap material over the body, the first and second tabs and over a second portion of each of the first and second triangular openings, wherein a portion of each triangular opening is only covered by said shrink wrap material, wherein at least one of said tabs is quadrilateral in shape, wherein said quadrilateral shaped tab has a base side adjacent the base of the triangular body, wherein quadrilateral shaped tab has a first side opposite a second side and a top side opposite its base side, wherein the first and second sides of said quadrilateral shaped tab extend from the base side to the top side, wherein the base side of the quadrilateral shaped tab has a length shorter than a length of its corresponding end of said first and second corresponding ends of said base of said triangular body.

8. A triangular package comprising:

a base;

a first side extending from the base;

a second side extending from the base opposite the first side and extending toward the first side, wherein the base, the first side and the second side define a triangular body having a first end opposite a second end, wherein the base, the first side and the second side define a first triangular opening on said first end and a second triangular opening on said second end;

a first tab extending from a first end of the base and covering a first portion of the first triangular opening, said first portion of said first triangular opening being at least 20% of the first triangular opening;

a second tab extending from a second end of the base opposite the first end and covering a first portion of the second triangular opening, said first portion of the second triangular opening being at least 20% of the second triangular opening; and a shrink wrap material over the body, the first and second tabs and over a second portion of each of the first and second triangular openings, wherein a portion of each triangular opening is only covered by said shrink wrap material, wherein at least one of said tabs is trapezoidal in shape, wherein said trapezoidal shaped tab has a base side adjacent the base of the triangular body, wherein trapezoidal shaped tab has a first side opposite a second side and a top side opposite its base side, wherein the first and second sides of said trapezoidal shaped tab extend from the base side to the top side, and wherein the first side of said trapezoidal shaped tab is adjacent the first side of the triangular body and the second side of said trapezoidal shaped tab is adjacent the second side of the triangular body.

9. The package as recited in claim 8, wherein the first side of the triangular body extends along a first angle relative to the base, and wherein the second side of the triangular body extends at a second angle relative to the base, wherein the first side of said trapezoidal shaped tab extends relative the base side of said trapezoidal shaped tab at a first tab angle that is the same as the first angle, and wherein the second side of said trapezoidal shaped tab extends relative the base side of said trapezoidal shaped tab at a second tab angle that is the same as the second angle.

10. The package as recited in claim 9, wherein the base side of the trapezoidal shaped tab has a length shorter than a length of its corresponding end of said first and second corresponding ends of said base of the triangular body.

11. The package as recited in claim 9, wherein the first side of the trapezoidal shape tab engages the first side of the triangular body and the second side of the trapezoidal shaped tab engages the second side of the triangular body.

12. The package as recited in claim 8, wherein the first side of the triangular body extends along a first angle relative to the base, and wherein the second side of the triangular body extends at a second angle relative to the base, wherein the first side of one of said first and second trapezoidal shaped tabs extends relative the base side of said one trapezoidal shaped tab at a first tab angle that is less than the first angle, and wherein the second side of said one trapezoidal shaped tabs extends relative the base side of said one trapezoidal shaped tab at a second tab angle that is less than the second angle.

13. The package as recited in claim 12, wherein the base side of said one trapezoidal shaped tab has a length shorter than a length of its corresponding end of said first and second corresponding ends of said base of said triangular body.

14. The package as recited in claim 8, wherein each tab does not extend externally beyond the first and second sides and the base of the triangular body.

15. The package as recited in claim 8, wherein the first tab covers less than 90% of the first triangular opening, and wherein the second tab covers less than 90% of the second triangular opening.

16. A triangular package comprising:

a base;

a first side extending from the base;

a second side extending from the base opposite the first side and extending toward the first side, wherein the base, the first side and the second side define a triangular body having a first end opposite a second end, wherein the base, the first side and the second side define a first triangular opening on said first end and a second triangular opening on said second end;

a first tab extending from a first end of the base and covering a first portion of the first triangular opening, said first portion of said first triangular opening being at least 20% of the first triangular opening;

a second tab extending from a second end of the base opposite the first end and covering a first portion of the second triangular opening, said first portion of the second triangular opening being at least 20% of the second triangular opening; and a shrink wrap material over the body, the first and second tabs and over a second portion of each of the first and second triangular openings, wherein a portion of each triangular opening is only covered by said shrink wrap material, wherein at least one of said tabs is quadrilateral in shape, wherein said quadrilateral shaped tab has a base side adjacent the base of the triangular body, wherein quadrilateral shaped tab has a first side opposite a second side and a top side opposite its base side, wherein the first and second sides of said quadrilateral shaped tab extend from the base side to the top side, wherein the base side of the quadrilateral shaped tab has a length shorter than a length of its corresponding end of said first and second corresponding ends of said base of said triangular body.

17. A triangular package comprising:

a base;

a first side extending from the base;

a second side extending from the base opposite the first side and extending toward the first side, wherein the base, the first side and the second side define a triangular body having a first end opposite a second end, wherein the base, the first side and the second side define a first triangular opening on said first end and a second triangular opening on said second end;

a first tab extending from a first end of the base and covering a first portion of the first triangular opening, said first portion of said first triangular opening being at least 20% of the first triangular opening;

a second tab extending from a second end of the base opposite the first end and covering a first portion of the second triangular opening, said first portion of the second triangular opening being at least 20% of the second triangular opening; and a shrink wrap material over the body, the first and second tabs and over a second portion of each of the first and second triangular openings, wherein a portion of each triangular opening is only covered by said shrink wrap material, wherein the first tab covers less than 50% of the first triangular opening, and wherein the second tab covers less than 50% of the second triangular opening.

18. The package as recited in claim 17, wherein each of said first and second tabs do not extend beyond the triangular body.

* * * * *